US005983046A

United States Patent [19]

Lee

[11] Patent Number: 5,983,046

[45] Date of Patent: Nov. 9, 1999

[54] DEVELOPER SUPPLYING APPARATUS OF WET ELECTROGRAPHIC PRINTER

[75] Inventor: Hyong-gu Lee, Puchun, Rep. of Korea

[73] Assignee: Samsung Electronics Co., Ltd., Kyungki-do, Rep. of Korea

[21] Appl. No.: 09/120,303

[22] Filed: Jul. 22, 1998

[30] Foreign Application Priority Data

Dec. 12, 1997 [KR] Rep. of Korea ..... 97-68313

[51] Int. Cl.[6] ..... G03G 15/10

[52] U.S. Cl. ..... 399/57; 399/58; 399/238

[58] Field of Search ..... 399/57, 58, 62, 399/237, 238; 347/131, 133

[56] References Cited

U.S. PATENT DOCUMENTS 5,722,017 2/1998 Caruthers, Jr. et al. ..... 399/238
5,832,334 11/1998 Corn et al. ..... 399/57

FOREIGN PATENT DOCUMENTS 52-10732 1/1977 Japan .
54-8451 of 1979 Japan .
56-32841 of 1981 Japan .
62-103678 5/1987 Japan .
63-19686 1/1988 Japan .
63-20170 2/1988 Japan .
3-18872 1/1991 Japan .
4-86688 3/1992 Japan .
5-503594 6/1993 Japan .

*Primary Examiner*—William Royer
*Assistant Examiner*—Greg Moldafsky
*Attorney, Agent, or Firm*—Sughrue, Mion, Zinn, Macpeak & Seas, PLLC

[57] ABSTRACT

A developer supplying apparatus of a wet electrographic printer is provided. The apparatus includes a reservoir for storing a developer obtained by mixing a liquid carrier with an ink, a carrier cartridge for supplying the liquid carrier to the reservoir through the carrier supplying path, an ink cartridge for supplying the ink to the reservoir through an ink supplying path, a developing unit for receiving the developer of the reservoir through the developer supplying path to developing an electrostatic latent image, and a process tank for storing the developer draining from the reservoir through a developer draining path.

9 Claims, 3 Drawing Sheets

DEVELOPER SUPPLYING APPARATUS OF WET ELECTROGRAPHIC PRINTER

BACKGROUND OF THE INVENTION

1. Field of the Invention

The present invention relates to a wet electrographic printer and, more particularly, to a developer supplying apparatus of a wet electrographic printer capable of controlling the concentration and level of the developer.

2. Description of the Related Art

In general, the wet electrographic printer is an apparatus for developing an electrostatic latent image formed on a photosensitive medium such as a photosensitive belt with a developer of a predetermined color and transferring the developed image to print a desired image on a paper sheet. The wet electrographic printer includes a developing unit for developing an image by supplying the developer to the photosensitive medium, and a developer supplying apparatus for constantly supplying the developer of a predetermined concentration to the developing unit. The developer is a mixture of concentrated ink containing a powder type toner and a liquid carrier, in which the toner is diluted to approximately 2~4 wt %. Hereinafter, the concentration of the developer is defined by the wt % of toner.

Meanwhile, the developer supplying apparatus includes an ink cartridge for storing condensed ink, a carrier cartridge for storing a liquid carrier, and a reservoir for storing the developer containing the condensed ink and the liquid carrier in a predetermined ratio. Also, agitators for preventing settling a toner of the solution may be installed in the ink cartridge and the reservoir, respectively.

In the developer supplying apparatus, the amount of developer stored in the reservoir is reduced by an amount used to develop the electrostatic latent image of the photosensitive medium, so that the condensed ink and the liquid carrier must be supplied to the reservoir to maintain the concentration of the developer at a constant concentration. Also, the level of developer stored in the reservoir must remain constant.

Also, the consumption of the toner and the liquid carrier may be different according to a printed image. That is, more liquid carrier than toner is required to print a simple image or a small image, and more toner than liquid carrier is required to print a complicated image. Thus, in order to maintain the concentration of the developer at a predetermined concentration, it is necessary to appropriately supply the toner and the developer to the reservoir in accordance with the consumption of the toner and the liquid carrier.

The developer supplying apparatus cannot control both the concentration of the developer stored in the reservoir and the level thereof. That is, if a lot of the liquid carrier is supplied to maintain the concentration of the developer in the reservoir at a predetermined level, the level of the developer may be changed and thus undesired operating conditions may be generated, or if the level of the developer is controlled, the concentration of the developer cannot be appropriately controlled.

SUMMARY OF THE INVENTION

To solve the above problem, it is an objective of the present invention to provide a developer supplying apparatus of a wet electrographic printer having an improved structure capable of appropriately controlling the concentration and the level of the developer.

Accordingly, to achieve the above objective, there is provided a developer supplying apparatus of a wet electrographic printer comprising: a reservoir for storing a developer obtained by mixing a liquid carrier with an ink and supplying the developer to a developing unit through a developer supplying path; a carrier cartridge for supplying the liquid carrier to the reservoir through the carrier supplying path; an ink cartridge for supplying the ink to the reservoir through an ink supplying path; and a process tank for storing the developer draining from the reservoir through a developer draining path.

Also, the apparatus further comprises a concentration sensor for sensing the concentration of the developer in the reservoir, in which the developer in the reservoir is drained to the process tank if the concentration sensor senses that the developer is not within a predetermined concentration range.

According to another embodiment of the present invention, the apparatus further includes a recycle path for supplying the developer in the process tank to the reservoir, and a valve for selectively opening and closing the ink supplying path, the carrier supplying path and the recycle path.

Also, the apparatus further includes a concentration sensor for sensing the concentration of the developer in the process tank, in which the valve selectively opens and closes the ink supplying path, the carrier supplying path and the recycle path according to the concentration of the developer measured by the concentration sensor to control the amount of the ink, the liquid carrier and the developer supplied to the reservoir, respectively.

According to still another aspect of the present invention, the apparatus further includes a developer removing path for supplying the developer in the reservoir and/or the process tank to the ink cartridge.

Also, the apparatus further includes a valve for selectively opening and closing the developer supplying path, the developer draining path and the developer removing path.

Also, the apparatus further includes a level sensor for measuring the amount of ink in the ink cartridge, in which if the ink in the ink cartridge is used up, the developer supplying path is closed and the developer removing path is opened by the valve.

BRIEF DESCRIPTION OF THE DRAWINGS

The above objectives and advantages of the present invention will become more apparent by describing in detail preferred embodiments thereof with reference to the accompanying drawings, in which.

DETAILED DESCRIPTION OF THE PREFERRED EMBODIMENTS

Figure 1:
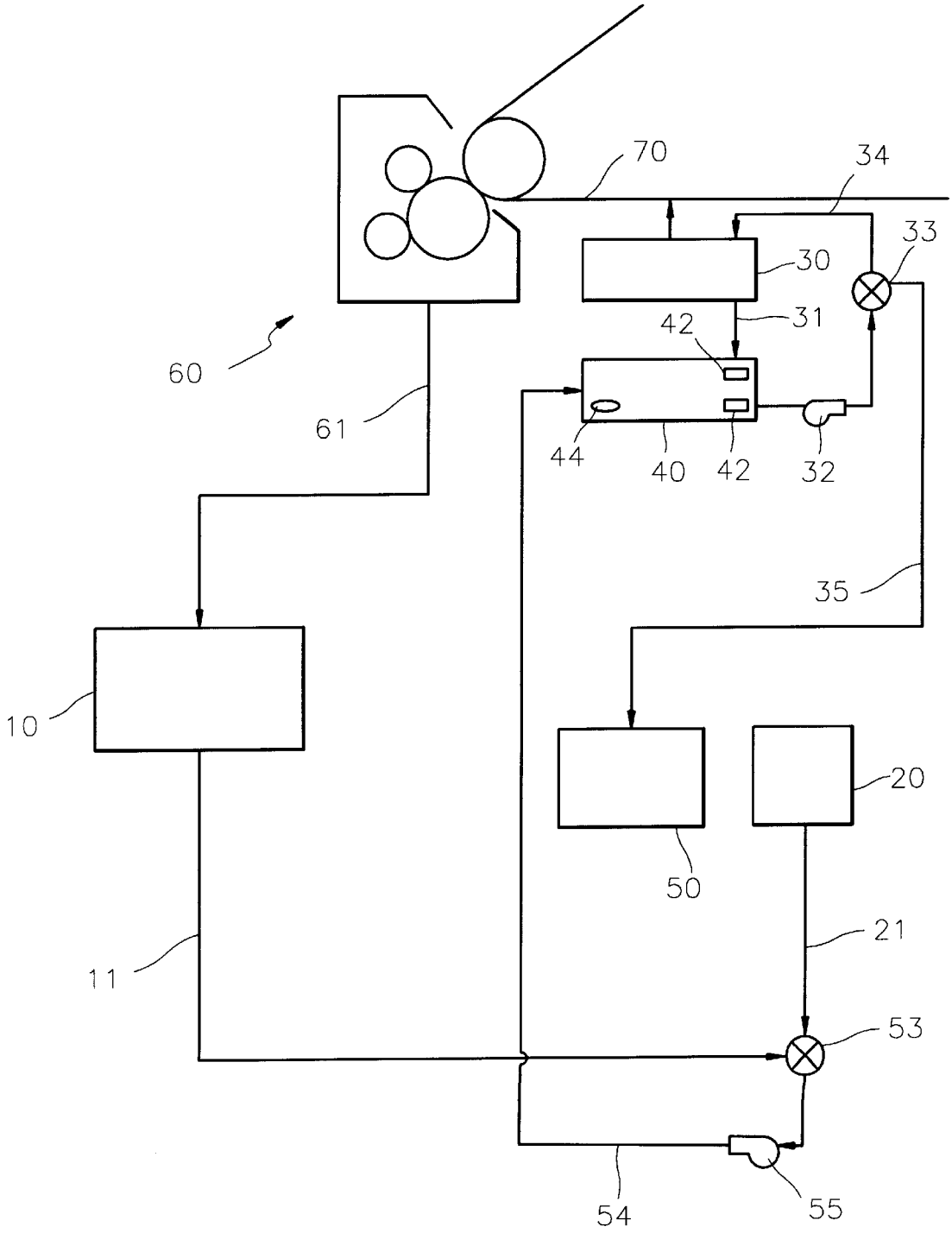
FIG. 1 is a schematic view of a developer supplying apparatus of a wet electrographic printer according to a first embodiment of the present invention.

Referring to FIG. 1 showing the structure of a developer supplying apparatus according to a first embodiment of the present invention, a liquid carrier is stored in a carrier cartridge 10, and condensed ink is stored in an ink cartridge 20. The carrier cartridge 10 and the ink cartridge 20 are replaceable.

The carrier cartridge 10 and the ink cartridge 20 are connected to a first valve 53 such as a solenoid two-way valve through a carrier supplying path 11 and an ink supplying path 21. The first valve 53 selectively opens and closes the carrier supplying path 11 and the ink supplying path 21, so that ink and liquid carrier are supplied to a reservoir 40 through an ink/carrier supplying path 54 by the driving force of a first pump 55.

Figure 2:
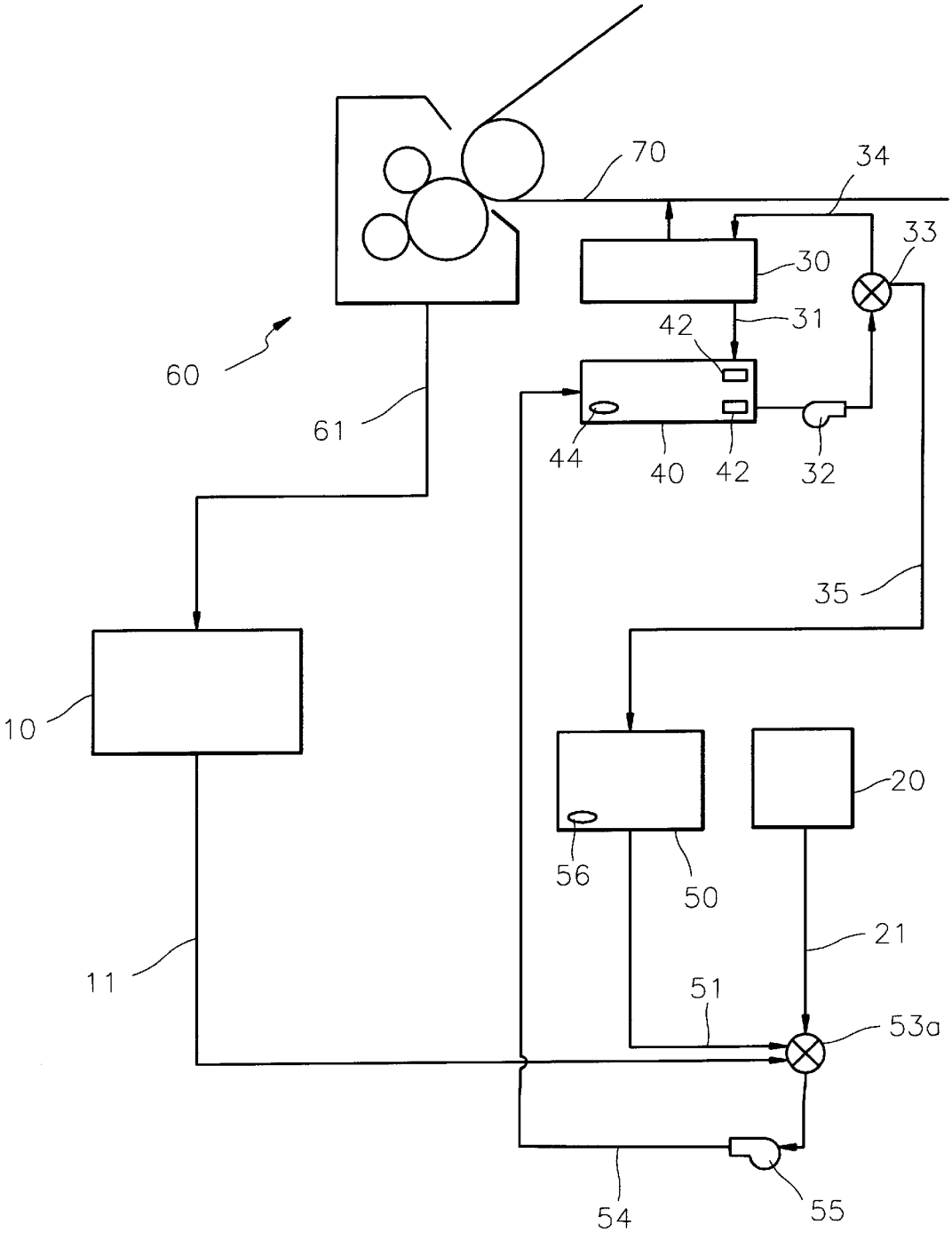
FIG. 2 is a schematic view of a developer supplying apparatus of a wet electrographic printer according to a second embodiment of the present invention.
Figure 3:
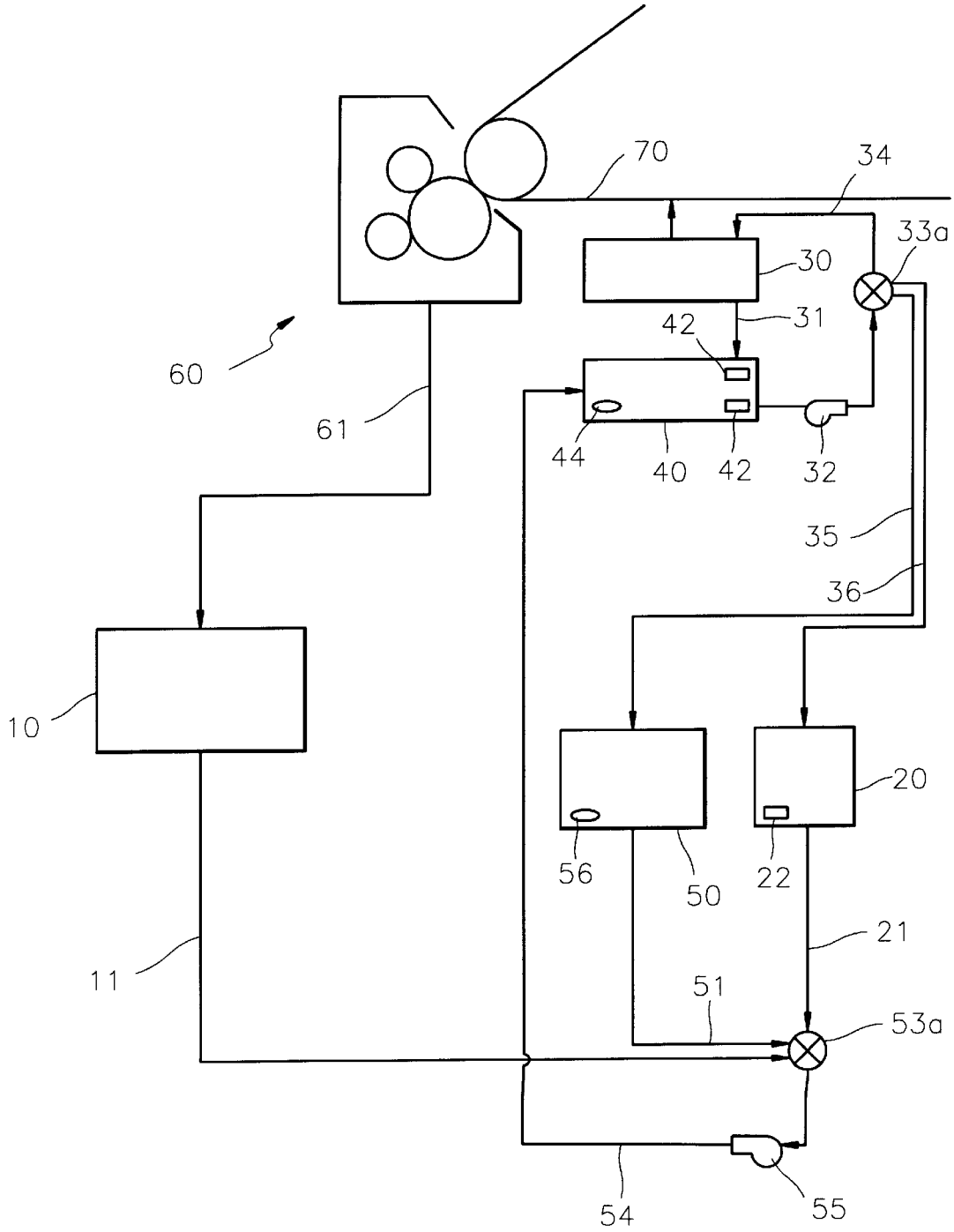
FIG. 3 is a schematic view of a developer supplying apparatus of a wet electrographic printer according to a third embodiment of the present invention.

A level sensor 42 for sensing the level of the developer in the developer reservoir 40 and a concentration sensor 44 for sensing the concentration thereof are installed in the reservoir 40. Also, the reservoir 40 supplies the developer obtained by mixing the ink with the liquid carrier to a developing unit 30 through a developer supplying path 34 according to the driving of a second pump 32. The developing unit 30 develops an electrostatic latent image formed in a photosensitive belt 70 using the developer supplied from the reservoir 40. As illustrated in FIGS. 1–3, the reservoir 40 may have multiple level sensors 42 for sensing the level of the developer.

A second valve 33 such as a solenoid two-way valve is installed in the developer supplying path 34, and the second valve 33 selectively blocks the developer supplying path 34 and a developer draining path 35. The developer supplying path 34 supplies the developer to the developer unit 30 and the developer draining path 35 drains developer to a process tank 50.

Reference numeral 60 denotes a drying unit for recovering liquid carrier adsorbed to the electrostatic latent image of the photosensitive belt 70, where the collected liquid carrier returns to the carrier cartridge 10 along a collection pipe 61.

The operation of the above developer supplying apparatus will now be described.

When the power to a printer is turned on, the first valve 53 selectively opens the ink supplying path 21 and the carrier supplying path 11 to supply ink and liquid carrier stored in the ink cartridge 20 and the carrier cartridge 10 to the reservoir 40. The supplied ink and liquid carrier are mixed with each other, so that the developer has a predetermined concentration and level.

Subsequently, the developer stored in the reservoir 40 is supplied to the developing unit 30 along the developer supplying path 34 by the driving force of the second pump 32 while the developer draining path 35 is closed. Thus, the electrostatic latent image formed on the photosensitive belt 70 is developed using the supplied developer. At this time, excess developer supplied to the photosensitive belt 70 is eliminated by collection means such as a squeegee roller (not shown) to be collected to the reservoir 40 through the path 31.

If the amount of ink consumed is different from that of carrier consumed due to the aforementioned printing conditions during printing, the concentration of the developer collected through the path 31 may be different from that of the developer supplied through the developer supplying path 34, so that the concentration of the developer stored in the developing reservoir tank 40 changes. Here, a concentration sensor 44, if sensing an abnormal concentration of the developer, transfers an information signal to the controller (not shown). The controller stops the printing according to the signal, and the second valve 33 operates to block the developer supplying path 34 and open the developer draining path 35. Thus, the developer in the developing reservoir tank 40 is drained to the process tank 50 by the driving of the second pump 32. This is to ensure there is sufficient room in the reservoir 40 to supply new ink and liquid carrier. At this time, the amount of developer drained can be appropriately controlled.

Subsequently, the first valve 53 operates and the ink and liquid carrier are supplied to the reservoir 40 to obtain a developer having an appropriate concentration.

According to the present invention, the developer of the reservoir 40 is partially drained to the process tank 50, to thereby easily control the concentration and level of the developer.

The structure of the developer supplying apparatus according to the second embodiment of the present invention is shown in FIG. 2. The same reference numerals and the same elements indicate the same members having the same functions shown in FIG. 1.

According to the second embodiment of the present invention, a process tank 50 is connected to a third valve 53*a*, such as a solenoid three-way valve, via a recycle path 51. Thus, developer in the process tank 50 is supplied to a reservoir 40 via the recycle path 51 and the third valve 53*a* to be reused.

A concentration sensor 56 installed in the process tank 50 measures the concentration of the developer in the process tank 50 to determine the amount of developer to be supplied to the reservoir 40.

In the operation of the developer supplying apparatus according to the second embodiment of the present invention, if the developer of a predetermined level, drained from the reservoir 40, is stored in the process tank 50, the concentration of the developer is measured by the concentration sensor 56, and thus an information signal thereof is transferred to the controller (not shown).

Subsequently, the controller drives the third valve 53*a* and thus selectively opens a carrier supplying path 11, an ink supplying path 21 and the recycle path 51, to thereby supply the developer in the process tank 50 together with the liquid carrier and the ink to the reservoir 40. At this time, the controller appropriately controls the amount of the ink and the liquid carrier supplied according to the concentration information of the transferred developer, to thereby maintain the final developer in the reservoir 40 at an appropriate concentration and level.

The structure of the developing supplying apparatus according to the third embodiment of the present invention is shown in FIG. 3. The same reference numerals and the same elements indicate the same members having the same functions shown in FIGS. 1 and 2.

According to the third embodiment of the present invention, when the used-up ink cartridge 20 is replaced with a new one, the developer containing undesired impurities in the reservoir 40 and the developing unit 30 can be drained to the used-up ink cartridge 20 to be thereby discarded together with the used-up ink cartridge 20. That is, the ink cartridge 20 is connected to a fourth valve 33*a*, such as the solenoid three-way valve, via a developer removing path 36. The fourth valve 33*a* selectively opens and closes a developer supplying path 34, a developer draining path 35 and a developer removing path 36. A level sensor 22 is installed in the ink cartridge 20, which detects whether the ink in the ink cartridge 20 is used up.

If the ink in the ink cartridge 20 is used up during printing, a signal from the level sensor 22 is transmitted to the controller (not shown). Then, the controller temporarily stops the printing, and operates the fourth valve 33*a* to block the developer supplying path 34 and the developer draining path 35 and open the developer removing path 36. Thus, the developer stored in the reservoir 40 is drained to the ink cartridge 20 through the developer removing path 36.

Also, in order to remove the developer in the process tank 50, the third valve 53*a* is driven by the controller to first supply the developer to the reservoir 40 through the recycle path 51 and the ink/carrier supplying path 54, and then the fourth valve 33*a* is driven to drain the developer to the ink cartridge 20 through the developer removing path 36.

Subsequently, the new ink cartridge is replaced, and then the ink and the liquid carrier are supplied to the reservoir 40 to restart the printing in the same manner as the above.

According to the present invention, a separate process tank allows the developer in the reservoir to be easily drained, so that the concentration of the developer and the level thereof can be easily controlled. Also, the developer in the process tank can be reused without variation in the concentration of the developer. Further, during replacement of the ink cartridge, the developer of a low quality or containing impurities can be removed.

In the specification, the developer supplying apparatus for one developing unit is disclosed. However, the above developer supplying apparatus may be employed in an electrographic color printer having a plurality of developing units corresponding to colors of, for example, yellow, magenta, cyan and black.

It is contemplated that numerous modifications may be made to the developer supplying apparatus for a wet electrographic printer of the present invention without departing from the spirit and scope of the invention as defined in the following claims.

What is claimed is:

1. A developer supplying apparatus of a wet electrographic printer comprising:

a reservoir for storing a developer obtained by mixing a liquid carrier with an ink and supplying the developer to a developing unit through a developer supplying path;

a carrier cartridge for supplying the liquid carrier to the reservoir through the carrier supplying path;

an ink cartridge for supplying the ink to the reservoir through an ink supplying path;

a process tank for storing the developer draining from the reservoir through a developer draining path; and a valve for selectively opening or closing the developer draining path and the developer supplying path.

2. The apparatus of claim 1, further comprising a concentration sensor for sensing the concentration of the developer in the reservoir, wherein the developer in the reservoir is drained to the process tank if the concentration sensor senses that the developer is not within a predetermined concentration range.

3. The apparatus of claim 1, further comprising a concentration sensor for sensing the concentration of the developer in the reservoir, wherein the developer supplying path is closed and the developer draining path is opened by the valve when the concentration of the developer sensed by the concentration sensor is not within a predetermined range.

4. The apparatus of claim 1, further comprising a recycle path for supplying the developer in the process tank to the reservoir.

5. The apparatus of claim 4, further comprising a valve for selectively opening and closing the ink supplying path, the carrier supplying path and the recycle path.

6. The apparatus of claim 5, further comprising a concentration sensor for sensing the concentration of the developer in the process tank, wherein the valve selectively opens and closes the ink supplying path, the carrier supplying path and the recycle path according to the concentration of the developer measured by the concentration sensor to control the amount of the ink, the liquid carrier and the developer supplied to the reservoir, respectively.

7. The apparatus of claim 1, further comprising a developer removing path for supplying the developer in at least one of the reservoir and the process tank to the ink cartridge.

8. The apparatus of claim 7, further comprising a valve for selectively opening and closing the developer supplying path, the developer draining path and the developer removing path.

9. The apparatus of claim 8 further comprising a level sensor for measuring the amount of ink in the ink cartridge, wherein when the ink in the ink cartridge is used up, the developer supplying path is closed and the developer removing path is opened by the valve.

* * * * *